US008856978B2

(12) United States Patent
Liebel et al.

(10) Patent No.: US 8,856,978 B2
(45) Date of Patent: Oct. 14, 2014

(54) HOME URINAL

(71) Applicants: Richard John Liebel, Port Charlotte, FL (US); Richard J. Liebel, II, North Wales, PA (US)

(72) Inventors: Richard John Liebel, Port Charlotte, FL (US); Richard J. Liebel, II, North Wales, PA (US)

( * ) Notice: Subject to any disclaimer, the term of this patent is extended or adjusted under 35 U.S.C. 154(b) by 0 days.

(21) Appl. No.: 13/573,664

(22) Filed: Oct. 3, 2012

(65) Prior Publication Data

US 2014/0090159 A1 Apr. 3, 2014

(51) Int. Cl.
*E03D 13/00* (2006.01)

(52) U.S. Cl.
CPC ..... *E03D 13/00* (2013.01)
USPC ..... 4/311

(58) Field of Classification Search
CPC ..... E03D 13/00
USPC ..... 4/301–442
See application file for complete search history.

(56) References Cited

U.S. PATENT DOCUMENTS

| | | | | | |
|---|---|---|---|---|---|
| 2,960,000 | A | * | 11/1960 | Thomas | 86/20.12 |
| 3,211,085 | A | * | 10/1965 | Zeppetello | 100/214 |
| 3,336,602 | A | * | 8/1967 | Kubit | 4/341 |
| 3,822,419 | A | * | 7/1974 | Wilson, Sr. | 4/144.4 |
| 3,922,729 | A | * | 12/1975 | Ashley | 4/331 |
| 3,964,110 | A | * | 6/1976 | Kapit | 4/311 |
| 3,971,093 | A | * | 7/1976 | Komatsu et al. | 15/104.93 |
| 4,137,579 | A | * | 2/1979 | Soler | 4/311 |
| 4,180,875 | A | * | 1/1980 | Wilson | 4/309 |
| 4,197,174 | A | * | 4/1980 | Chang | 522/55 |
| 4,282,611 | A | * | 8/1981 | O'Day | 4/144.1 |
| 4,549,321 | A | * | 10/1985 | Douillard | 4/301 |
| 4,750,219 | A | * | 6/1988 | Williams | 4/301 |
| 5,027,448 | A | * | 7/1991 | Wilkins | 4/310 |
| 5,153,947 | A | * | 10/1992 | Markles | 4/342 |
| 5,255,397 | A | * | 10/1993 | Poole | 4/310 |
| 5,287,563 | A | * | 2/1994 | Peters | 4/310 |
| D354,122 | S | | 1/1995 | Carlier | |
| 5,655,230 | A | | 8/1997 | Corbin | |
| 5,806,107 | A | * | 9/1998 | Tilton et al. | 4/310 |
| 6,088,845 | A | * | 7/2000 | Estrada | 4/306 |
| 6,408,449 | B1 | * | 6/2002 | Aguirre | 4/342 |
| 6,862,754 | B1 | * | 3/2005 | DeMarco | 4/304 |
| 7,291,275 | B1 | * | 11/2007 | Davis et al. | 210/708 |
| D640,779 | S | * | 6/2011 | Bates | D23/313 |
| 7,992,231 | B1 | * | 8/2011 | Schlicksup | 4/300.3 |
| 8,291,522 | B2 | * | 10/2012 | Kueng | 4/144.1 |
| 8,387,171 | B2 | * | 3/2013 | Farber et al. | 4/305 |
| 2005/0039248 | A1 | * | 2/2005 | DeMarco | 4/310 |

OTHER PUBLICATIONS p. 25 Mumbai to Miami Washington AP Mar. 29, 2012 North Mexico Wilts Durango Mexico AP Dec. 2, 2011.
p. 26 Scientist say . . . Seth Bornstein AP Jul. 4, 2012.
p. 27 Excerpts from "The Urinal", Andrew Howe Feb. 2, 2011.
p. 28 Bill Gates Foundation Aug. 15, 2012 p. 29.
p. 30 Rising Seas, Delores Savas, Sep. 7, 2012.
p. 31 Items from the Web, 2,960,000 web sights dealing wit Water Shortage and several other news items.

(Continued)

*Primary Examiner* — Lori Baker

(57) ABSTRACT

A lightweight urinal designed for low water use and intended to be used adjacent to a toilet in a household residence. Device connects to existing water source and waste lines with minimal effort by a homeowner or professional installer. Push button control in combination with the shape of the urinal flushes contents automatically after use while using just 15 ounces of water.

7 Claims, 3 Drawing Sheets

(56) References Cited

OTHER PUBLICATIONS p. 32 At least 36 states . . . Sep. 2011.
p. 33 Texas sewage into drinking water . . . , Sun News AP Aug. 11, 2011.
p. 34 Al.,Ga.,Fl., Water Wars . . . Atlanta AP Aug. 13, 2011.
p. 35 Cattle to market . . . , Sun Newspaper, Aug. 12, 2012.
p. 37 Dem. California Grace Napolitano Sep. 22, 2011.
p. 38 Parched Earth, Brian Walsh, Time mag. Aug. 2011 p. 39 continued . . .
p. 40 7 Billion people . . . , David Crary AP Oct. 16, 2011.
p. 41 3 seperate articles on waterall in 2012.
p. 42 Product Features and Benefits.

* cited by examiner

HOME URINAL

FIELD OF INVENTION

This invention relates to water closets and urinals.

BACKGROUND

The human body must rid itself of body fluids in the form of urine. This urine is accumulated in the bladder where it is stored, stretching its elastic like walls until the bladder sends a signal to the brain that it has attained "full" status. While the bladder has been receiving this urine it has been expanding and forcing the walls to stretch. This stretching in turn continues to create an increased pressure on the urine which is being held in check by the squeezing of the urinary tube which is surrounded by the stronger muscle of the prostate gland. When the brain receives the signal from the bladder that it is "full" it in turn sends a signal to the prostate gland to release or relax the pressure on the urinary tube allowing the urine; under pressure, to pass through the urinary tube located in the male penis. The wall of urinary tube in the penis expands as the pressurized urine enters it and flows toward the outlet or head of the penis where it is expelled by the bladder pressure. As the bladder pressure is reduced and the urine flow is diminished, the prostate again increases its pressure on the urinary tube as that bladder empties itself. The bladder is again ready to accept urine which will again be kept in check as the prostate muscle again squeezes the urinary tube and the process starts all over again. Due to the released amount of urine and the reduction in bladder pressure to expel the last of the urine, the walls of the urinary tube and the muscles of the penis puts the squeeze on any remaining urine and empties the urinary tube. The urine; having been expelled from the end of the urinary tube, which has now lost it's bladder pressure is pushed from the head of the penis and into space where it is immediately effected by atmospheric pressure and forcing it to create an arc from the end of the penis down to the urinal surface below. This stream of urine, upon leaving the end of the penis is in many instances fractured due to the unevenness of the penis opening and may create several fractures due to the solid stream along with many droplets breaking away from the perimeter of those fractured streams and are known as "splatter". These streams and droplets under atmospheric pressure are being forced down into a resistance such as a flat bottom of the urinal bowl, a flat metal strainer, a somewhat flat rubber or plastic screen or an accumulated amount of water whose purpose is to create a soil pipe gas liquid seal in the urinal trap. Many of these conditions have been occurring for the last 150 years plus and has been the reason for the noisy sound of one urinating with splash and splatter of urine toilet seats, rims and floors. These basic same basic problems still occur today. In order to control the flow of these fractured and splatter streams of urine, one must make the receiving surface compatible rather then harsh. Therefore, a need remains for a urinal capable of overcoming these faulty, prior designs.

SUMMARY

Accordingly, an embodiment of the present invention is directed to an automated no splash urinal device, comprising: a vertically elongated receptacle bowl configured to inhibit a liquid from exiting the vertically elongated receptacle bowl as a stream of the liquid is directed into the vertically elongated receptacle bowl; a flushing mechanism, comprising: a flush valve configured for a four second operating flush, the four second operating flush producing 15 ounces of flush water; a water supply line configured to supply flush water to the flush valve; a flush hose for a left side of the vertically elongated receptacle bowl; a flush hose for a right side of the vertically elongated receptacle bowl; a flush tube for a rear wall of the vertically elongated receptacle bowl; a lighting mechanism, comprising: a motion detector for detecting a presence of a user of the automated no splash urinal device; two light emitting diodes (LED) configured to illuminate the vertically elongated receptacle bowl; a battery configured to supply power to the two LED; a water trap configured for receiving a content of the vertically elongated receptacle bowl, the water trap comprising: a three ounce water supply contained in the water trap, the water trap configured for prevention of gas flow from a sewage line; the water trap further configured a vertical distance from the stream of liquid, the vertical distance sufficient to eliminate direct contact between the stream of liquid and the three ounce water supply, wherein the automated no splash urinal device weighs less than ten pounds.

An additional embodiment of the present invention includes a removable top for servicing, the removable top is further configured with an offset hole in the removable top, the offset hole configured for a protruding flush valve activator, the removable top is further configured with a motion detector hole for the motion detector.

An additional embodiment of the present invention includes a flush valve configured for automatic shut-off, the automated no splash urinal device is fabricated of Polymeric material, and the automated no splash urinal device is further configured to couple to a wall via two integral hangers.

BRIEF DESCRIPTION OF THE DRAWINGS

The numerous advantages of the present invention may be better understood by those skilled in the art by reference to the accompanying figures in which.

DETAILED DESCRIPTION

A lightweight, less than 10 Lbs. non ceramic urinal, which hangs on two wall brackets. It comes with a water supply line connected to a push type flush valve with auto shutoff, delivering 15 ounces of flushing water or 5 times the amount of drain pipe trap liquid of 3 ounces. This urinal develops no urinating sounds, splash or splatter from any of its parts. The urinal receiving bowl has an elongated drain pipe connecting to a soil pipe trap and drain line which connects to a fitting set into a drilled hole in the side of the toilet giving access to the toilets internal drain pipe system or the drain line can be connected directly into any soil pipe.

It is in the most simple, familiar design and uncomplicated construction containing significant and unique elements of improvements that make it capable of outperforming all previous urinals and financially accessible to the mass population throughout the world, even in our struggling economies. This invention addresses all of the known problems that have existed since the first urinal was made, some one hundred and fifty years ago. Listed here are the ten known problems and complaints that this invention addresses and ultimately corrects. #1. The waste of fresh water. #2. High cost of present urinals and flush valves. #3. Expensive installation. #4. Maintenance. #5. Urine contamination around urinals, allowing bacteria to develop and putting health at risk. #6. Splattering and splashing or urine on those urinating. #7. Odors that permeates the surrounding air. #8. Cost on average, the use of many light bulbs used to illuminate a bathroom and many are to often left on. #9. The sound of someone urinating followed by the loud flushing of many gallons of-fresh water for only a few ounces of urine.

Figure 1:
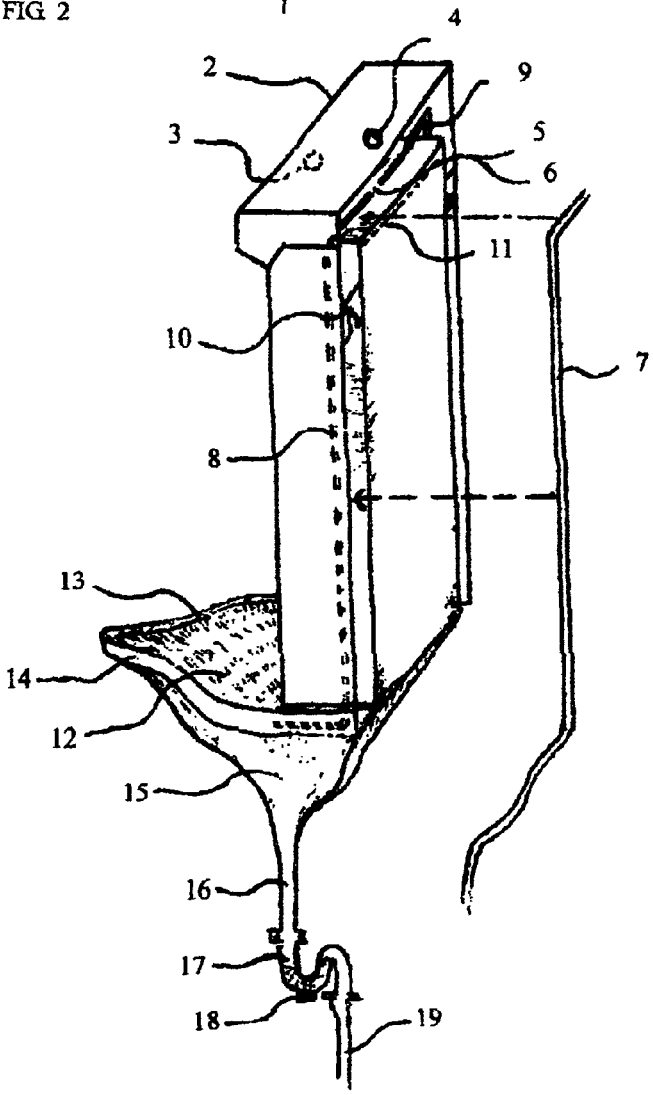
FIG. 1 is a perspective view of the first embodiment of this invention.

The Home Urinal accomplishes to an acceptable degree that has never been reached before due to its special designs. FIG. 1 shows a perspective view of one embodiment of the present invention. Using a receding and deep and descending surface of the urinal bowl 12 from under and inside the top lip 13 of the urinal bowl down towards the deep oversized elliptical cone, the inside vertical sides of which lead into the drain line 19.

FIG. 1 displays additional components of the home urinal including 2 is a perspective view of the urinal lid 2, the hole 3 in the front of the lid for "eve" of motion detector, the hole 4 in the top of the lid for flush valve activation, the space 5 for the flush valve body, the space 6 for the motion detector, the fresh water tube 7 from toilet service valve to flush valve, the internal flush hose 8 for the right side, the flush hose 9 for the left side, the two wall hanger brackets 10, the inside upper wall rear wall flushing tube 11, the redesigned urinal bowl 12, the urinal bowl top flush water control flange 13, the urinal bowl outside top flush water control flange 14, the outside lower section 15 of the urinal bowl, the elongated drain pipe section 16 of the urinal bowl the drain pipe trap 17, the drain pipe trap clean out plug 18, and the drain pipe 19.

Figure 2:
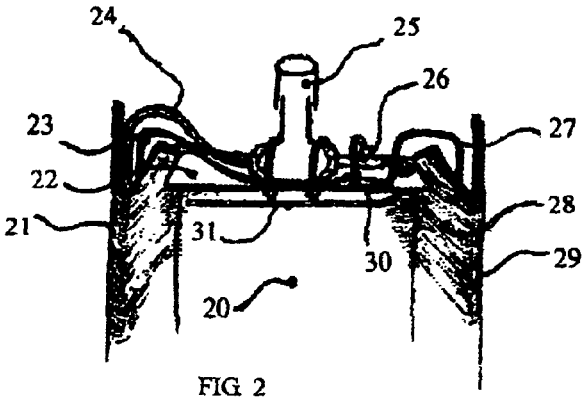
FIG. 2 Is a perspective view of the embodiment of the urinal top section.

FIG. 2 shows a perspective view of one embodiment of the urinal top section. Elements of the top section may include: an interior rear wall 20 of the urinal, the left side wall 21, the shelf 22, for the flush valve and motion detector, the left side flush tube 23, the service water tube 24 to inlet side of flush valve, the "press to activate" flush valve 25, the flush valve outlet "T" connection 26, the right side flushing tube 27, the inside right wall 28 of the urinal, the outside right wall 29 of the urinal, the "T" connection 30 for both side wall flush tubes, and the interior rear wall top flushing tube 31.

Figure 3:
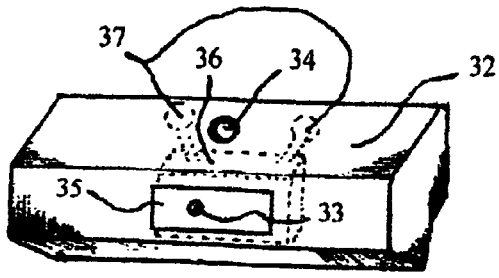
FIG. 3 is a perspective view of the embodiment of the urinal top lid.

FIG. 3 shows a perspective view of one embodiment of the urinal top lid. Elements of the top lid of the urinal may include: the top lid 32 the hole 33 in the front of the lid, for "eve" of motion detector, the hole 34 in the top of the lid, for flush valve activator, the large decal 35 indicating "Faucet Shuts-Off Automatically," the motion detector and battery case 36, and the two LED lifetime light bulbs 37.

Figure 4:
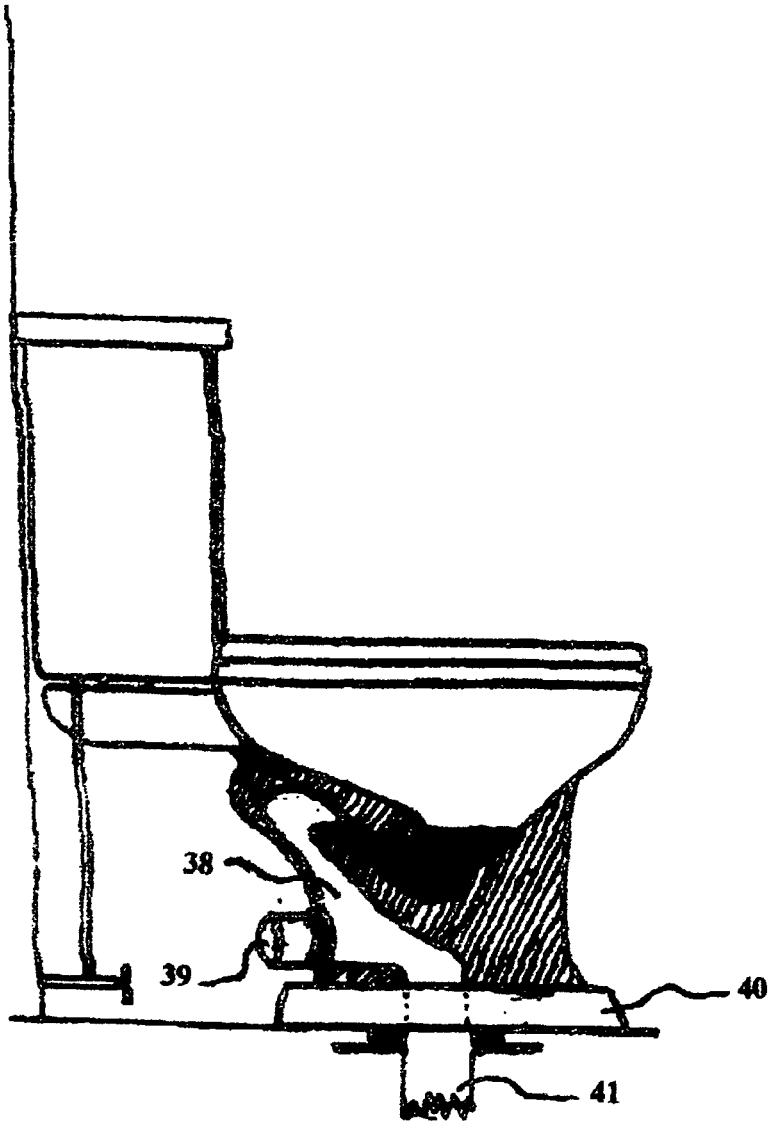
FIG. 4 is a perspective view of one embodiment of the toilet connection.

FIG. 4 shows a perspective view of one embodiment of the toilet connection. Elements of the toilet connection may include: the internal toilet drain pipe 38, the drain pipe adapter fitting 39, the toilet base 40, and the soil pipe 41. In this embodiment, a hole is wet drilled in the toilet base wall on either side or the rear just above the base plate and a fluid type coupling means 39 is installed for joining the urinal drain lines 19 to the toilet internal sewage pipe 38.

Figure 5:
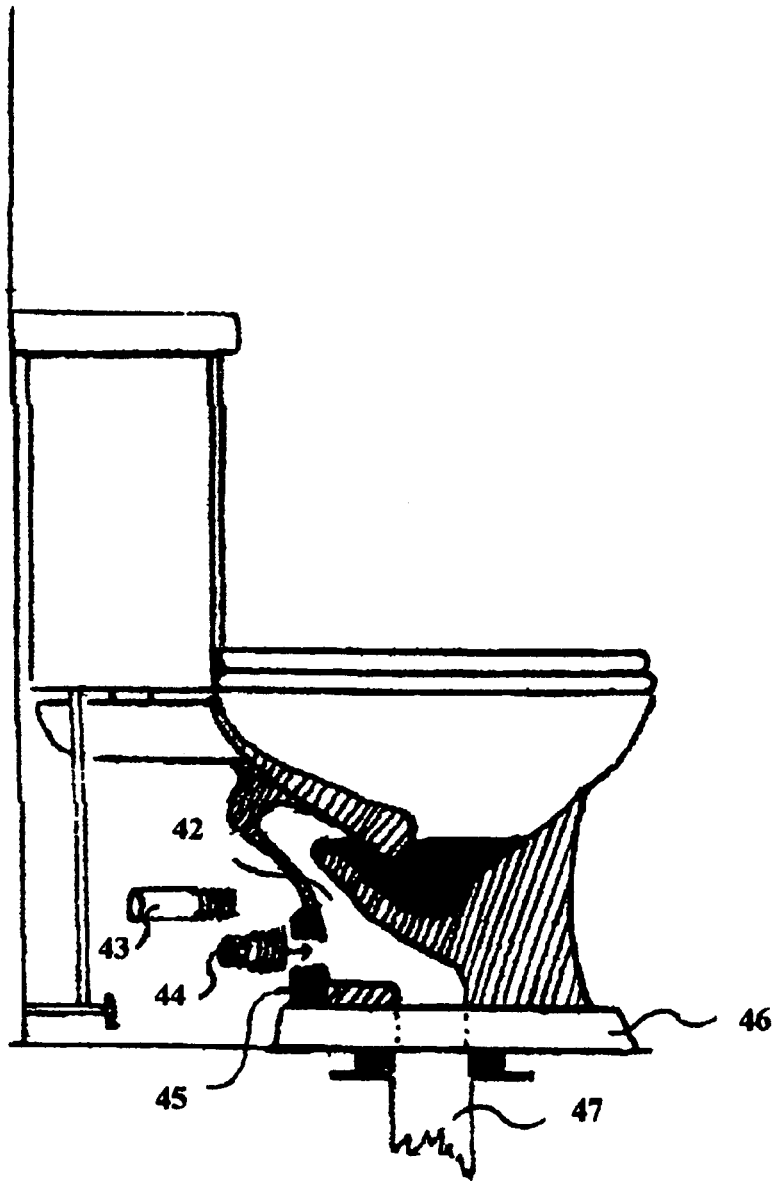
FIG. 5 is a perspective view of one embodiment of the toilet connection.

FIG. 5 shows a perspective view of one embodiment of the toilet connection. Elements of the toilet connection may include: the internal toilet drain pipe 42, the threaded drain pipe adapter fitting 43, the factory installed threaded plug 44 for shipping, the thicker threaded section 44 of the toilet wall, the toilet base 46, and the soil pipe 47. In this embodiment, the drain line 19 is connected directly into the toilet threaded drain pipe adapter fitting 43 via thicker threaded section 44. Additionally, drain pipe 19 may be directly connected into a septic tank or other type of drain field application.

This invention deals with those previous indicated problems by making these following improvements. Some of which are, #1 The least amount of fresh water required per flush in the industry of 15 ounces whose flush valve is quiet and takes only 4 seconds to operate. #2 A no splash, no splatter quiet urinal. #3Newly designed angular surface of the receptacle bowl combining to develop an elongated drain pipe 16. Although this urinal drain pipe 16 is elongated, it does not negate the person from seeing the liquid in the trap 17 at its base which is required by some plumbing codes. Within the same elongated drain pipe 16 the urine stream angle which is much lower than the visual angle, will not allow the urine stream to directly impinge on the liquid in the trap 17 therefor no splash or splatter can transpire. #4 The relocation of the drain pipe trap 17 along with joining the drain line with the toilet internal sewage pipe 34 and 42. Along with these improvements the Home Urinal comes with all the hardware required to install it within most bathrooms. This includes the fresh water line 7 and compression fittings, the "T" fittings and internal flush lines 23 and 27 secured by the "U" bolt and mounted flush valve, battery operated Motion Detector 36 and two LED light bulbs and batteries, 37, two wall fasteners, 10 drain pipes 19 Ells and couplings along with chemicals and instructions.

There is a lightweight cover or lid on the urinal 32 much like any toilet tank lid. The flush valve 25 protrudes up through the center of the lid 34 for easy access along with a decal 35 on the front of the lid indicating "FAUCET SHUTS OFF AUTOMATICALLY". There is also a hole in the front center 33 where the Motion Detector sensor "eye" 36 fits flush with the front lip of the lid. The sensor will activate when someone enters a darkened bathroom or at night. The sensor illumination is from two small LED lifetime light bulbs 37 battery powered and bright enough to do almost anything in the bathroom, it will remain on for two minutes after one leaves the bathroom giving a soft glow back to their room. This is a safety factor for the young, old and everyone in between because when one leaves a illuminated room into a dark hallway or bedroom, one must wait until our vision adjust to the darkness. The urinal top 32 is very lightweight and also removable to make any service adjustments which may become necessary, such as battery changes every two years. The entire urinal weighs less than ten pounds and hangs on the wall using two supplied wall hangers 10. The Home Urinal is easy to install and operate, easy to clean with brush supplied and service if necessary. It also eliminates that female question "WHO LEFT THE SEAT UP" once and for all as males will no longer be required to lift the seat on a toilet to urinate. It is "Whisper Quiet" in operation both for urinating and for flushing. The total cost of the total cost of the complete kit will be less than one third of those on the market today. It should have a return on investment of only 2 years, saving you money and a 1,000 gallons of fresh water per month per mate person for many years to come. Installation can be done by a Do-It-Yourself person or by a plumber in less than 4 hours. The walls and floor need not be disturbed and the inch and a quarter drain pipe meets plumbing code with no electric required.

We claim:

1. An automated no splash urinal device, comprising:

a vertically elongated receptacle bowl configured to inhibit a liquid from exiting the vertically elongated receptacle bowl as a stream of the liquid is directed into the vertically elongated receptacle bowl;

a flushing mechanism, comprising:

a flush valve configured for a four second operating flush, the four second operating flush producing 15 ounces of flush water;

a water supply line configured to supply flush water to the flush valve;

a flush hose for a left side of the vertically elongated receptacle bowl;

a flush hose for a right side of the vertically elongated receptacle bowl;

a flush tube for a rear wall of the vertically elongated receptacle bowl;

a lighting mechanism, comprising:

a motion detector for detecting a presence of a user of the automated no splash urinal device;

two tight emitting diodes (LED) configured to illuminate the vertically elongated receptacle bowl;

a battery configured to supply power to the two LED;

a water trap configured for receiving a content of the vertically elongated receptacle bowl, the water trap configured for maintaining a three ounce water supply contained in the water trap, the water trap further configured for prevention of gas flow;

the water trap further configured a vertical distance from the stream of liquid, the vertical distance sufficient to eliminate direct contact between the stream of liquid and the three ounce water supply;

wherein the automated no splash urinal device weighs less than ten pounds.

2. The automated no splash urinal device of claim 1, further comprising a removable top for servicing.

3. The automated no splash urinal device of claim 2, wherein the removable top is further configured with an offset hole in the removable top, the offset hole configured for a protruding flush valve activator.

4. The automated no splash urinal device of claim 2, wherein the removable top is further configured with a motion detector hole for the motion detector.

5. The automated no splash urinal device of claim 1, wherein the flush valve is configured for automatic shut-off.

6. The automated no splash urinal device of claim 1, wherein the automated no splash urinal device is fabricated of Polymeric material.

7. The automated no splash urinal device of claim 1, wherein the automated no splash urinal device is further configured to couple to a wall via two integral hangers.

* * * * *